US008360623B2

(12) United States Patent
Lin et al.

(10) Patent No.: US 8,360,623 B2
(45) Date of Patent: Jan. 29, 2013

(54) SIDE-ILLUMINATING LIGHT GUIDE DEVICE FOR A VEHICLE

(75) Inventors: Chiun-Jie Lin, Fontana, CA (US); Yung-Hua Chen, Fontana, CA (US)

(73) Assignee: Maxzone Auto Parts Corp.CA (US)

( * ) Notice: Subject to any disclaimer, the term of this patent is extended or adjusted under 35 U.S.C. 154(b) by 289 days.

(21) Appl. No.: 12/690,927

(22) Filed: Jan. 20, 2010

(65) Prior Publication Data

US 2011/0058382 A1 Mar. 10, 2011

(30) Foreign Application Priority Data

Sep. 4, 2009 (TW) ..... 98216420 U

(51) Int. Cl.
*F21V 9/00* (2006.01)

(52) U.S. Cl. ..... 362/511; 362/620; 362/560

(58) Field of Classification Search ..... 362/610, 362/620, 555, 559, 560, 511, 545, 311.02
See application file for complete search history.

(56) References Cited

U.S. PATENT DOCUMENTS 3,043,947 A * 7/1962 Albinger, Jr ..... 362/634
4,344,110 A * 8/1982 Ruediger ..... 362/560
5,390,436 A * 2/1995 Ashall ..... 362/618
5,838,403 A * 11/1998 Jannson et al. ..... 349/65
5,980,054 A * 11/1999 Fukui et al. ..... 362/625
6,299,334 B1 * 10/2001 Schwanz et al. ..... 362/511
6,786,613 B2 * 9/2004 Suzuki ..... 362/600
7,142,753 B2 * 11/2006 Lee ..... 362/560
2002/0163790 A1 * 11/2002 Yamashita et al. ..... 362/31
2004/0095769 A1 * 5/2004 Huang et al. ..... 362/339
2005/0002175 A1 * 1/2005 Matsui et al. ..... 362/31
2005/0024849 A1 * 2/2005 Parker et al. ..... 362/31
2008/0298080 A1 * 12/2008 Wu et al. ..... 362/555

* cited by examiner

*Primary Examiner* — Ismael Negron

(74) *Attorney, Agent, or Firm* — CKC & Partners Co., Ltd.

(57) ABSTRACT

A lighting device for a vehicle includes a light conducting rod, at least one light source, at least one first reflecting part, and at least one second reflecting part. The light source is connected to at least one end of the light conducting rod. The first reflecting part and the second reflecting part are located on the light conducting rod and respectively have a reflecting surface toward the light source. A first distance between the first reflecting part and the light source is less than a second distance between the second reflecting part and the light source, and the curvature of the reflecting surface of the second reflecting part is greater than the curvature of the reflecting surface of the first reflecting part.

18 Claims, 7 Drawing Sheets

SIDE-ILLUMINATING LIGHT GUIDE DEVICE FOR A VEHICLE

RELATED APPLICATIONS

This application claims priority to Taiwan Application Serial Number 98216420, filed Sep. 4, 2009, which is herein incorporated by reference.

BACKGROUND

1. Technical Field

The present disclosure relates to illumination. More particularly, the present disclosure relates to reflector type modifiers.

2. Description of Related Art

For driving safety and pedestrians' safety, several different functions of optical devices for lighting, warning, or instruction need to be installed in a vehicle. The light emitted from the optical devices need to be consistent for providing well function of warning or lighting, no matter what function the optical device is.

However, the conventional lighting device for the vehicle has only one light source, and the light source is connected to the one end of the conventional lighting device. Most of the light emitted from the light source is refracted out of the conventional lighting device when the conventional lighting device is not straight line shaped. Alternatively, most of the light is totally reflected toward the other end of the conventional lighting device. Therefore, the intensity of the light refracted from the overall lighting device is different, so the brightness of the light refracted from overall lighting device is inconsistent.

SUMMARY

According to one embodiment of the present invention, a lighting device for a vehicle is provided. The lighting device includes a light conducting rod, at least one light source, at least one first reflecting part, and at least one second reflecting part. The light source is connected to at least one end of the light conducting rod. The first reflecting part is located on the light conducting rod and has a reflecting surface toward the light source. The second reflecting part is located on the light conducting rod and has a reflecting surface toward the light source. A first distance between the first reflecting part and the light source is less than a second distance between the second reflecting part and the light source. The curvature of the reflecting surface of the second reflecting part is greater than the curvature of the reflecting surface of the first reflecting part.

According to another embodiment of the present invention, a lighting device for a vehicle is provided. The lighting device includes a light conducting rod, at least one light source, at least one first protrusion, at least one second protrusion, and at least one third protrusion. The light source is connected to at least one end of the light conducting rod. The first protrusion is located on the light conducting rod and has a linear side toward the light source. The second protrusion is located on the light conducting rod and has a curved side toward the light source. A first distance between the first protrusion and the light source is less than a second distance between the second protrusion and the light source. The third protrusion is located on the light conducting rod and has a curved side toward the light source. The second distance is less than a third distance between the third protrusion and the light source. The curvature of the curved side of the third protrusion is greater than the curvature of the curved side of the second protrusion.

DETAILED DESCRIPTION

In the following detailed description for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Figure 1A:
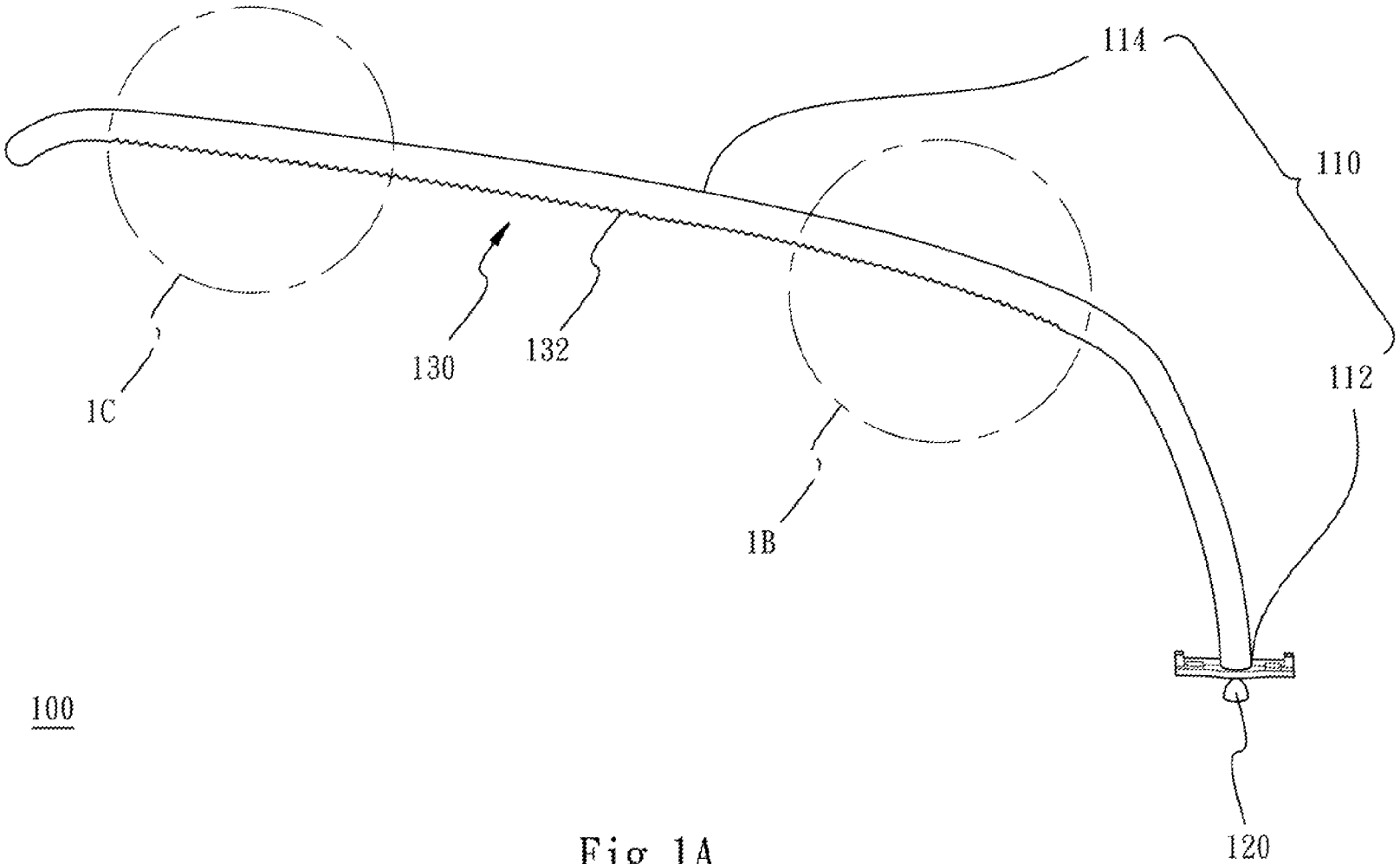
FIG. 1A is a perspective view of a lighting device for a vehicle according to one embodiment of this invention.

FIG. 1A is a perspective view of a lighting device 100 for a vehicle according to one embodiment of this invention. The lighting device 100 includes a light conducting rod 110, a light source 120, and several reflecting parts 130. The light conducting rod 110 has at least one light-receiving end 112 and a light-emitting surface 114. The light conducting rod 110 is solid and transparent. According to an embodiment, the light conducting rod 110 is made of polymethylmethacrylate. The light conducting rod 110 is bar-shaped (shown in FIG. 1A) or ring-shaped to provide different lighting shapes.

The light source 120 is connected to at least one end of the light conducting rod 110. In detail, the lights emitted from the light source 120 light toward the light-receiving end 112 of the light conducting rod 110.

Figure 1B:
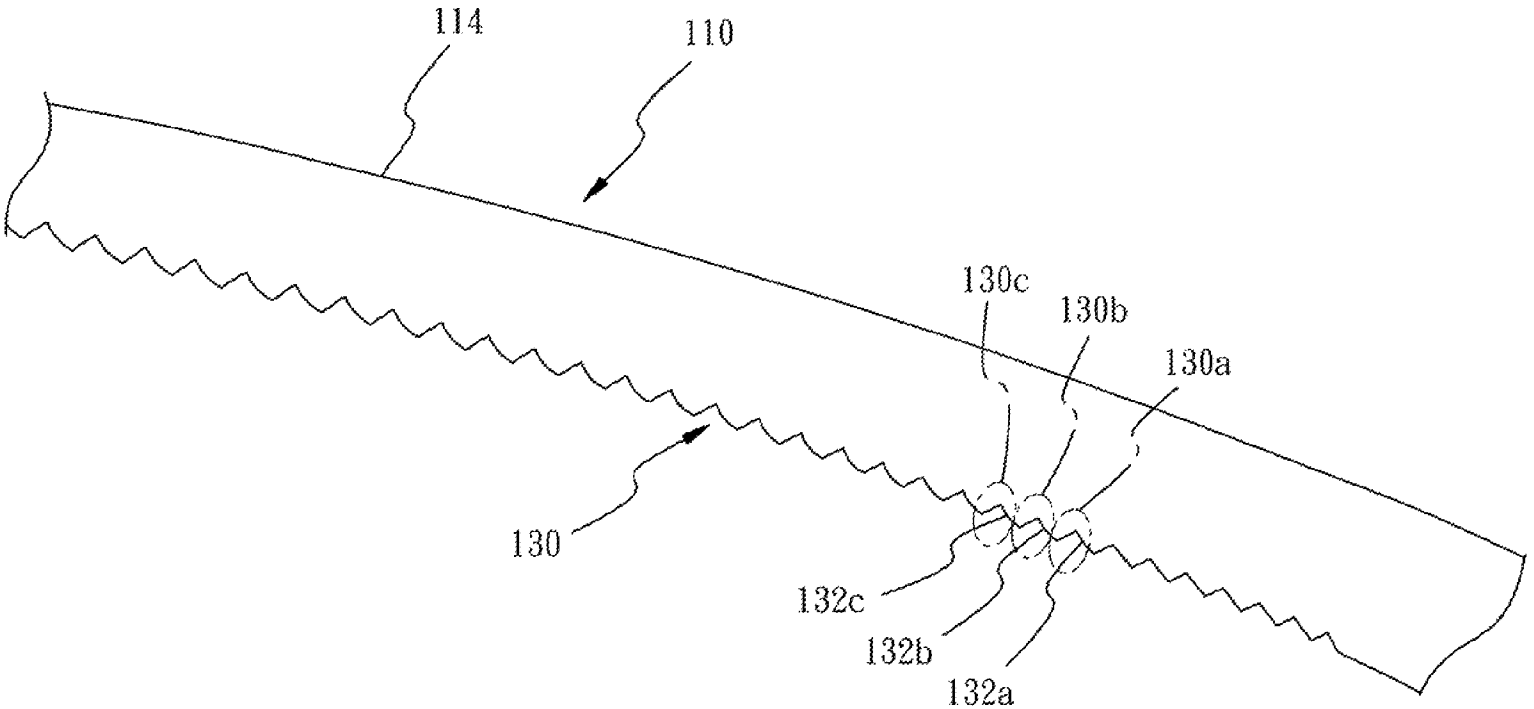
FIG. 1B is an enlarged view of the part 1B of FIG. 1A.

FIG. 1B is an enlarged view of the part 1B of FIG. 1A. The reflecting parts 130 are protrusions located on the light conducting rod 110 and each has a reflecting surface 132 toward the light source 120. The curvatures of the reflecting surfaces 132 of the reflecting parts 130 gradually increase with the distance from the light source 120.

The first reflecting part 130*a*, the second reflecting part 130*b* and the third reflecting part 130*c* are taken as an example. The first reflecting part 130*a*, the second reflecting part 130*b*, and the third reflecting part 130*c* each has a reflecting surface 132*a*, 132*b*, 132*c* toward the light source 120. A first distance between the first reflecting part 130*a* and the light source 120 is less than a second distance between the second reflecting part 130*b* and the light source 120, and a third distance between the third reflecting part 130*c* and the light source 120 is greater than the second distance.

In addition, the curvature of the reflecting surface 132*b* of the second reflecting part 130*b* is greater than that of the reflecting surface 132*a* of the first reflecting part 130*a*, and the curvature of the reflecting surface 132*c* of the third reflecting part 130*c* is greater than that of the reflecting surface 132*b* of the second reflecting part 130*b*. Therefore, some lights are effectively reflected toward the other end of the lighting device 100 by the reflecting surfaces 132 of the reflecting parts 130 with different curvatures, and the other lights are refracted out of the lighting device 100. Since the intensity of the lights refracted from overall of the lighting device 100 are similar, the brightness of the lights refracted from overall lighting device are consistent.

Figure 1C:
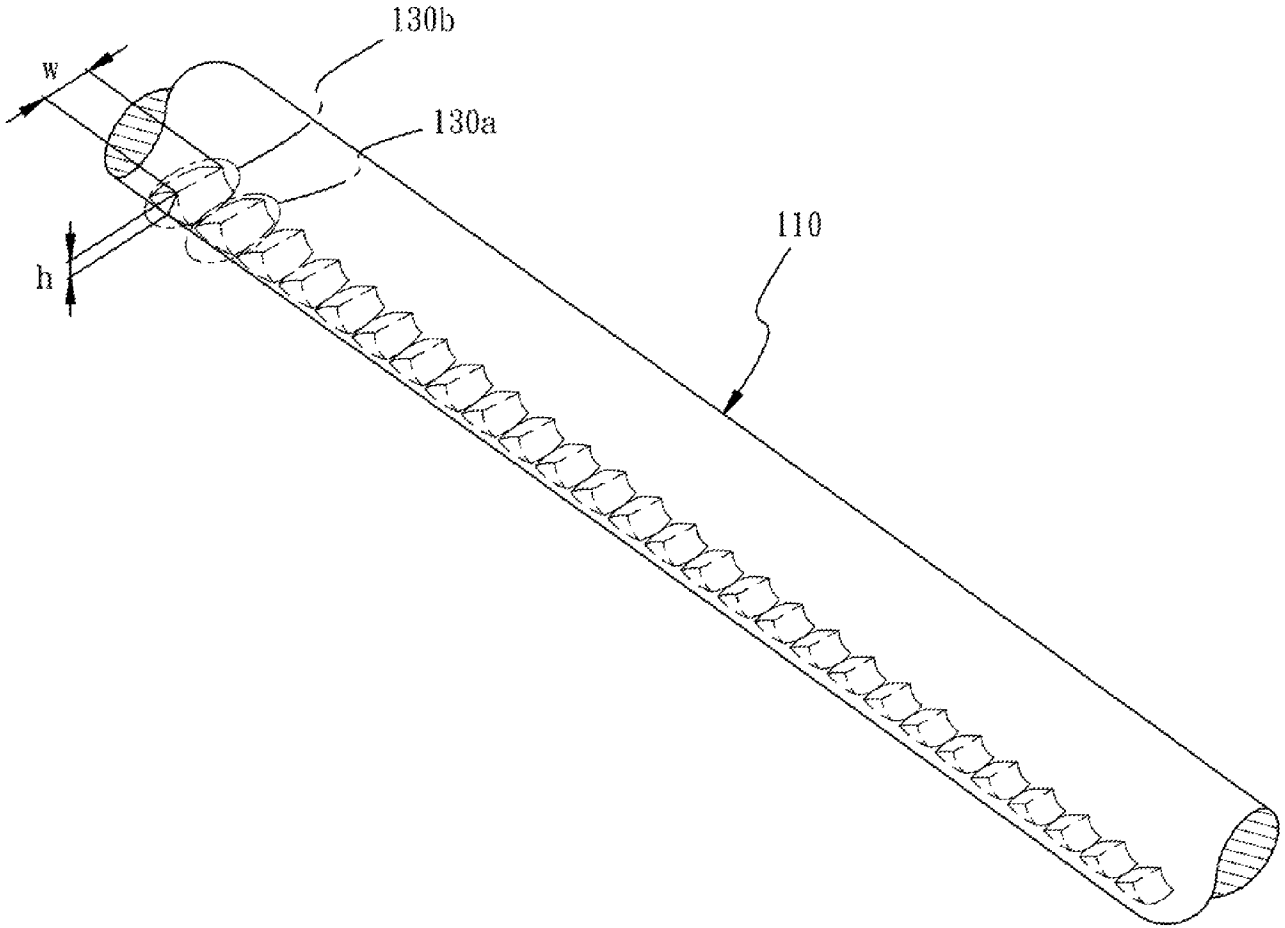
FIG. 1C is a perspective view of the part 1C of FIG. 1A.

FIG. 1C is an enlarged perspective view of the part 1C of FIG. 1A. The depths and/or the widths of the reflecting parts 130 are positively correlated with the distances between the reflecting parts 130 and the light source 120. In other words, the depth and/or the width of each reflecting part 130 can be increased as the increase of the distance between each reflecting part 130 and the light source 220.

In detail, since some lights are refracted out of the lighting device 100 after the lights are reflected by the first reflecting part 130*a*, the lights hitting the second reflecting part 130*b* are less. In order to increase the lights hitting the second reflecting part 130*b*, the depth h of the second reflecting part 130*b* is greater than that of the first reflecting part 130*a*. Furthermore, the width w of the second reflecting part 130*b* is greater than that of the first reflecting part 130*a*. Therefore, some lights emitted from the light source 120 directly hit the second reflecting part 130*b* without being reflected by the first reflecting part 130*a*. Accordingly, the lights refracted out of the lighting device 100 are consistent after the lights are reflected by the first or the second reflecting part.

Figure 2:
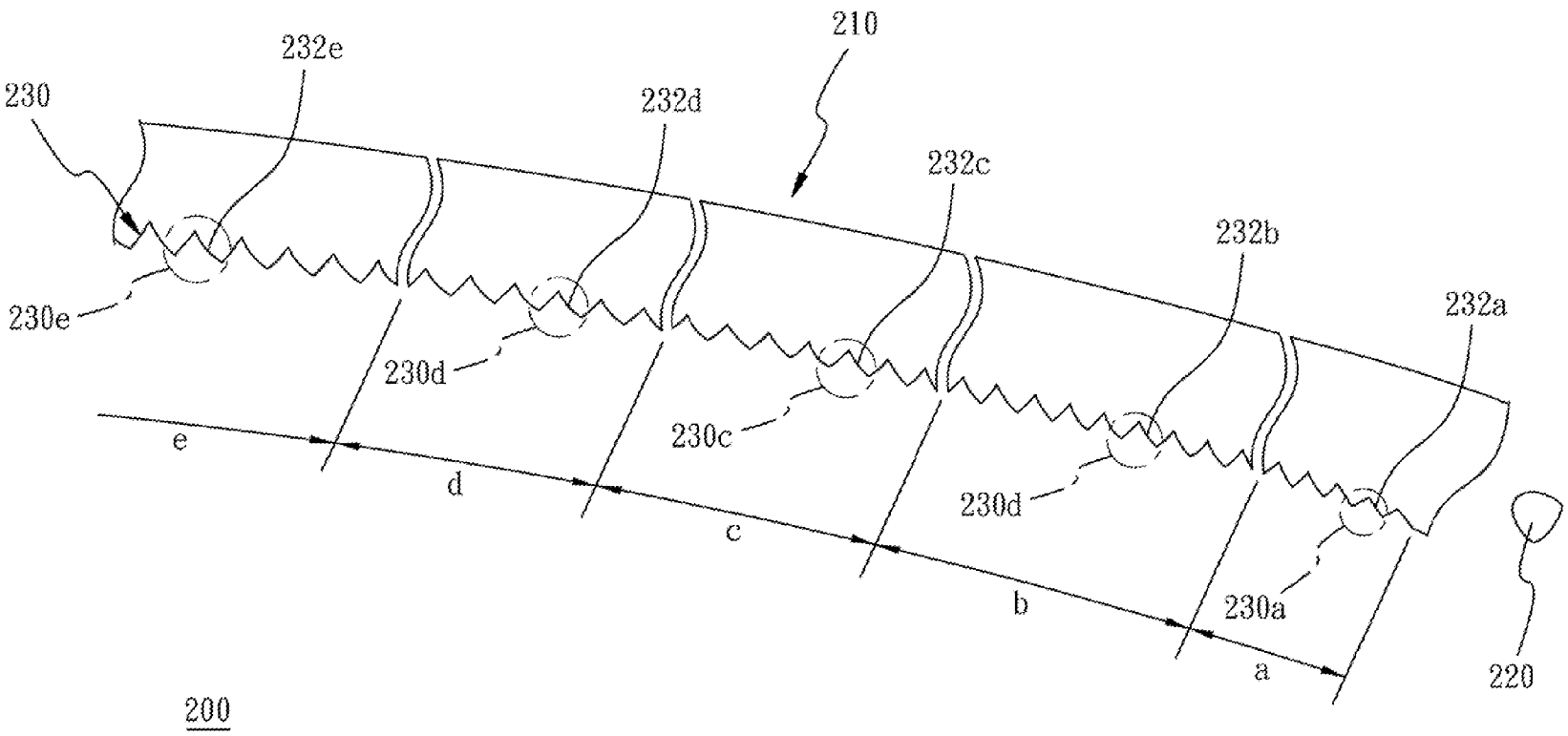
FIG. 2 is a plane view of a lighting device for a vehicle according to another embodiment of this invention.

FIG. 2 is a plane view of a lighting device 200 for a vehicle according to another embodiment of this invention. The detail structures of the light conducting rod 210 and the light source 220 are substantially the same as those of the lighting device 100 of the foregoing embodiment. The difference between the lighting devices 100 and 200 is as follows.

According to the embodiment, the reflecting parts 230 are divided into several segments. Each segment has more than two reflecting parts 230. In detail, the reflecting parts 230 are divided into five segments, the first segment a to the fifth segment e. The first segment a has several first reflecting parts 230*a*, the second segment b has several second reflecting parts 230*b*, and so on, as shown as FIG. 2. A first distance between the first segment a and the light source 220 is less than a second distance between the second segment b and the light source 220, the second distance is less than a third distance between the third segment c and the light source 220, and so on.

Each first reflecting part 230*a* has a linear side 232*a* toward the light source 220, and each of the other reflecting parts 230*b*, 230*c*, 230*d*, 230*e* has a curved side 232*b*, 232*c*, 232*d*, 232*e* toward the light source 220. The curvatures of the curved sides 232*b* of the second reflecting parts 230*b* are the same, the curvatures of the curved sides 232*c* of the third reflecting parts 230*c* are the same, and so on. In addition, the curvatures of the curved sides 232*c* of the third reflecting parts 230*c* are greater than that of the curved sides 232*b* of the second reflecting parts 230*b*, the curvatures of the curved sides 232*d* of the forth reflecting parts 230*d* are greater than that of the curved sides 232*c* of the third reflecting parts 230*c*, and so on. In other words, the curvatures of the curved sides 232*b* of the second reflecting parts 230*b* are smallest, and the curvatures of the curved sides 232*e* of the fifth reflecting parts 230*e* are largest. According to an embodiment, the curved sides of the reflecting parts are high-order surfaces. The high-order surface means a surface with third-order or more than third-order.

In addition, the depths of the reflecting parts 230 are positively correlated with the distances between the reflecting parts 230 and the light source 220. For example, the depth of the first reflecting part 230*a* can be increased as the increase of a first distance between the first reflecting part 230*a* and the light source 220. Furthermore, the depths of the first reflecting parts 230*a* are smaller than that of the second reflecting parts 230*b*, the depths of the second reflecting parts 230*b* are smaller than that of the third reflecting parts 230*c*, and so on. In other words, the more distance between the reflecting part with the light source is, the more depth of the reflecting part is.

The relationship between the widths of the reflecting parts 230 is similar to the foregoing embodiment. The details are not described again.

Figure 3:
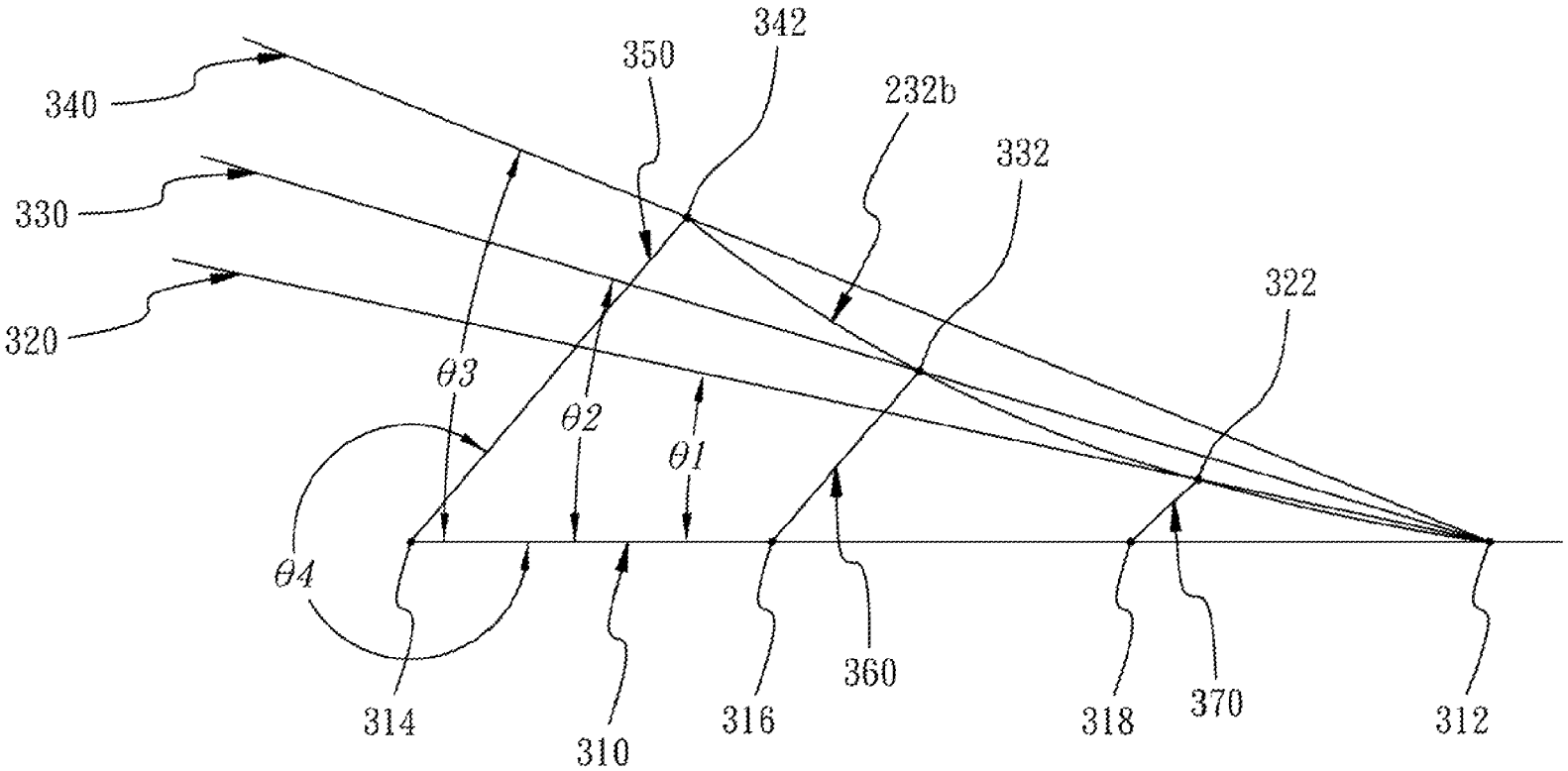
FIG. 3 is a plane view of the curved side of the reflecting part of FIG. 2.
Figure 4A:
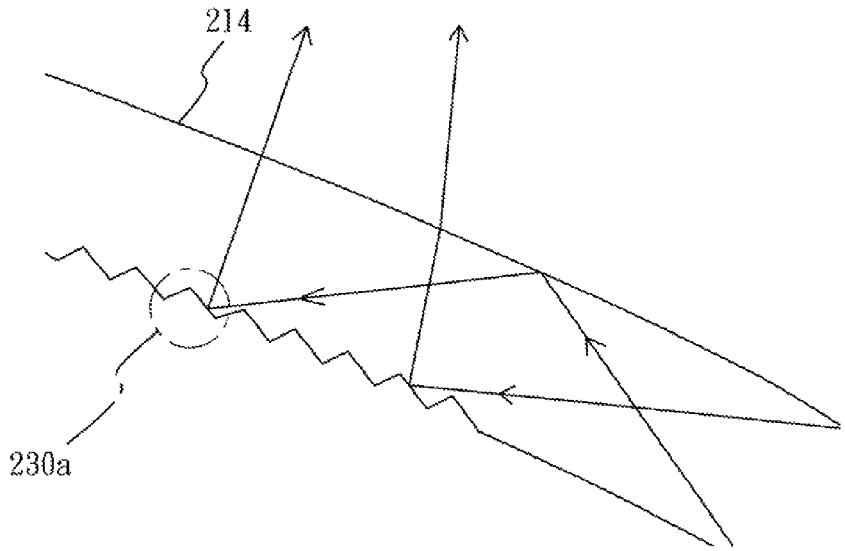
FIGS. 4A-4E are plane views of lights hitting the reflecting parts sequentially.
Figure 4B:
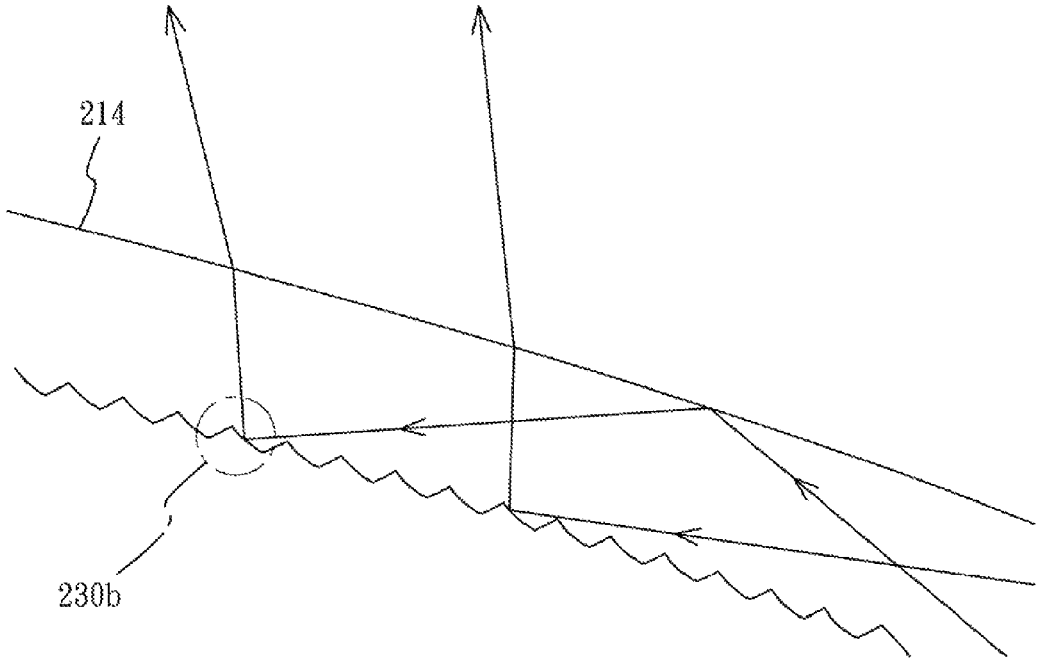
Figure 4C:
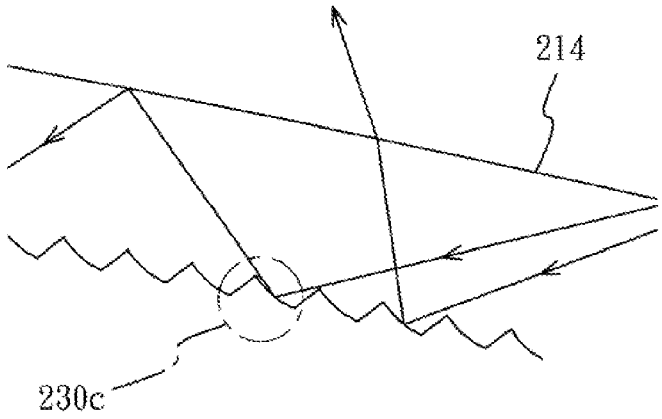
Figure 4D:
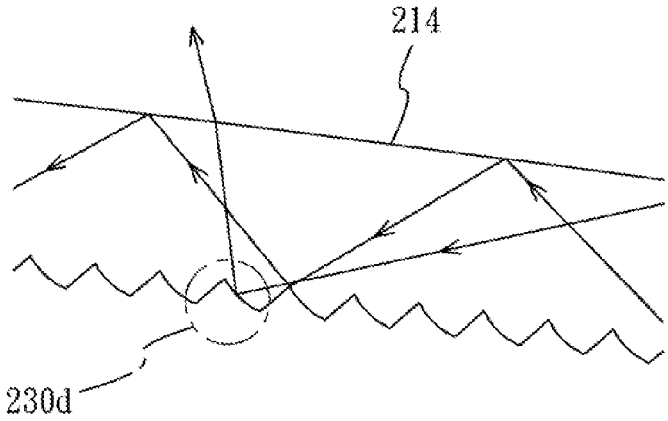
Figure 4E:
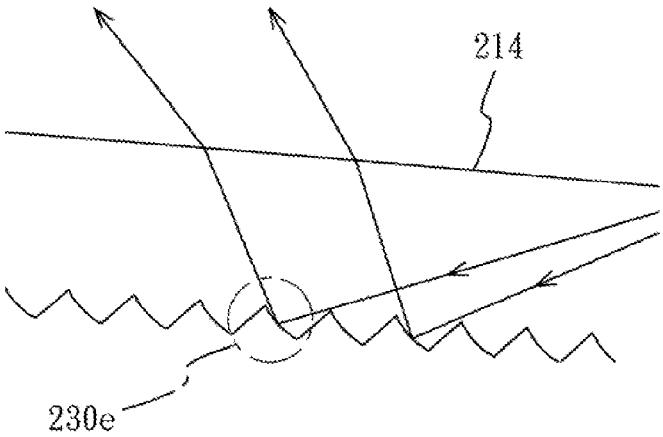

FIG. 3 is a plane view of the curved side 232*e* of the reflecting part 230*e* of FIG. 2. The method for designing the curved sides of the reflecting parts is described as following. It is appreciated that the designing method described hereinafter is only one embodiment of the present invention and is not intended to limit the scope of the invention.

In FIG. 3, a non-specific reflecting part 230*e* is taken as an example to illustrate how to design the reflecting parts 230*b*-230*e*. Angles θ1-θ4 are determined according to the incident angles of lights intended to hit the curved side 232*e*. A horizontal line 310 is created from the origin corner 312. Reference lines 320-340 are created from the origin corner 312, wherein the reference lines 320-340 are at the angles θ1-θ3 respectively with the horizontal line 310. The location of an edge corner 314 is determined on the horizontal line 310, wherein the edge corner 314 is separated from the origin corner 312 by a predetermined distance. A linear side 350 is created from the edge corner 314, wherein the linear side 350 is at the angle θ4 with the horizontal line 310. The linear side 350 and the reference line 340 cross at a top corner 342. The horizontal line segment between the edge corner 314 and the origin corner 312 is trisected by points 316 and 318. Reference lines 360 and 370 are created from the points 316 and 318 respectively, wherein the reference lines 360 and 370 are parallel with the linear side 350. The reference line 360 crosses the reference line 330 at a point 332, and the to reference line 370 crosses the reference line 320 at a point 322. The curve side 232*e* is created from the top corner 342 to the origin corner 312 through the points 332 and 322. The curved side 232*e* designed by the foregoing method is a third-order surface.

Particularly, the angles θ1, θ2, θ3 are the differences between the incident angles of the lights intended to hit the curved side 232*e* and the critical angle of the material of the light conducting rod 210. In the present embodiment, assuming that the incident angles of the lights intended to hit the curved side 232*e* are 60°, 70°, and 80° respectively, and the material of the light conducting rod 210 is polymethylmethacrylate (having a critical angle of 42.15°), the angle θ1 is 17.85° (the differences between 60° and 42.15°), the angle θ2 is 27.85° (the differences between 70° and 42.15°), and the angle θ3 is 37.85° (the differences between 80° and 42.15°).

Furthermore, the angle θ4 is smaller than or equal to the difference between 360° and the critical angle of the material of the light conducting rod 210. In the present embodiment, assuming the material of the light conducting rod 210 is polymethylmethacrylate (having a critical angle of 42.15°), the angle θ4 is 317.85° (the differences between 360° and 42.15°).

The other reflecting parts 230*b*, 230*c*, 230*d* can be designed by the foregoing method, but the incident angles of the lights intended to hit the curved sides of the reflecting parts may vary. In the present embodiment, the incident angles of the lights intended to hit the curved sides 232*b* are 30°, 40°, and 50° respectively, the incident angles of the lights intended to hit the curved sides 232*c* are 40°, 50°, and 60° respectively, and the incident angles of the lights intended to hit the curved sides 232*d* are 50°, 60°, and 70° respectively.

FIGS. 4A-4E are plane views of the lights hitting the reflecting parts 230*a*-230*e* sequentially. The lights are represented by arrow lines in FIGS. 4A-4E. The total reflections of the incident lights are destroyed by the different curvatures of the reflecting parts and the high-order surfaces of the curved sides when the incident lights are reflected by the curved sides of the reflecting parts. Therefore, some lights, which are reflected by every reflecting part, are refracted out of the lighting device from the light-emitting surface 214. The overall lighting device can emit the lights with consistent brightness.

The reader's attention is directed to all papers and documents which are filed concurrently with his specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, 6th paragraph. In particular, the use of "step of" in the claims is not intended to invoke the provisions of 35 U.S.C. §112, 6th paragraph.

What is claimed is:

1. A side-illuminating light guide device for a vehicle, the side-illuminating light guide device comprising:

a light conducting rod;

at least one light source connected to at least one end of the light conducting rod;

at least one first reflecting part located on the light conducting rod and haying a first surface and a first curved reflecting surface toward the light source, the first curved reflecting surface being closer to the light source than the first surface; and at least second reflecting part located on the light conducting rod and having a second surface and a second curved reflecting surface toward the light source, the second curved reflecting surface being closer to the light source than the second surface;

wherein a first distance between the first reflecting part and the light source is less than a second distance between the second reflecting part and the light source, and a curvature of the second curved reflecting surface of the second reflecting part is greater than a curvature of the first curved reflecting surface of the first reflecting part; and wherein a distal end of the first surface of the first reflecting part is immediately adjacent to a distal end of the second curved reflecting surface of the second reflecting part to thereby form a pointed end with the distal ends of the first surface of the first reflecting part and the second curved reflecting surface of the second reflecting part, and further form a roughly triangular structure between the first reflecting part and the second reflecting part.

2. The side-illuminating light guide device of claim 1, wherein there is a plurality of the first reflecting parts.

3. The side-illuminating light guide device of claim 1, wherein there is a plurality of the second reflecting parts.

4. The side-illuminating light guide device of claim 1, further comprising:

at least one third reflecting part located on the light conducting rod and having a third surface and a third curved reflecting surface toward the light source, the third curved reflecting surface being closer to the light source than the third surface; wherein a third distance between the third reflecting part and the light source is greater than the second distance, and a curvature of the third curved reflecting surface of the third reflecting, part is greater than the curvature of the second curved reflecting surface of the second reflecting part.

5. The side-illuminating light guide device of claim 1, wherein a depth of the second reflecting part is greater than a depth of the first reflecting part.

6. The side-illuminating light guide device of claim 1, wherein a width of the second reflecting part is greater than a width of the first reflecting part.

7. The side-illuminating light guide device of claim 1, wherein the light conducting rod is bar-shaped.

8. A side-illuminating light guide device for a vehicle, the side-illuminating light guide device comprising:

a light conducting rod;

at least one light source connected to at east one end of the light conducting rod;

at least one first protrusion located on the light conducting rod and having a first side and a first linear side toward the light source, the first linear side being closer to the light source than the first side;

at least one second protrusion located on the light conducting rod and having a second side and a second curved side toward the light source, the second curved side being closer to the light source than the second side, wherein a first distance between the first protrusion and the light source is less than as second distance between the second protrusion and the light source; and at least one third protrusion located on the light conducting rod and having a third side and a third curved side toward the light source, the third curved side being closer to the light source than the third side, wherein the second distance is less than a third distance between the third protrusion and the light source, and a curvature of the third curved side of the third protrusion is greater than a curvature of the second curved side of the second protrusion;

wherein a distal end of the second side of the second protrusion is immediately adjacent to a distal end of the third curved side of the third protrusion to thereby form a pointed end with the distal ends of the second side of the second protrusion and the third curved side of the third protrusion, anti further form a roughly triangular structure between the second protrusion and the third protrusion.

9. The side-illuminating light guide device of claim 8, wherein there is a plurality of the second protrusions.

10. The side-illuminating light guide device of claim 8, wherein the second curved side of the second protrusion is a high-order surface.

11. The side-illuminating light guide device of claim 8, wherein the third curved side of the third protrusion is a high-order surface.

12. The side-illuminating light guide device of claim 8, wherein there is a plurality of the third protrusions.

13. The side-illuminating light guide device of claim 8, wherein a width of the first protrusion is smaller than a width of the second protrusion.

14. The side-illuminating light guide device of claim 8, wherein a width of the second protrusion is smaller than a width of the third protrusion.

15. The side-illuminating light guide device of claim 8, wherein a depth of the first protrusion is smaller than a depth of the second protrusion.

16. The side-illuminating light guide device of claim 8, wherein a depth of the second protrusion is smaller than a depth of the third protrusion.

17. The side-illuminating light guide device of claim 8, wherein each of a depth of the first protrusion, a depth of the second protrusion and a depth of the third protrusion is positively correlated with a distance to the light source therefrom.

18. The side-illuminating light guide device of claim 8, wherein the light conducting rod is bar-shaped.

* * * * *